US006729980B1

(12) United States Patent
Lu et al.

(10) Patent No.: US 6,729,980 B1
(45) Date of Patent: May 4, 2004

(54) JAM FREE DEVICE FOR A TABLE TENNIS SERVING MACHINE

(75) Inventors: Sheng-Nan Lu, Shulin (TW); Chen-Chun Ko, Shulin (TW)

(73) Assignee: Shin Zu Shing Co., Ltd., Shulin (TW)

( * ) Notice: Subject to any disclaimer, the term of this patent is extended or adjusted under 35 U.S.C. 154(b) by 0 days.

(21) Appl. No.: 10/351,827

(22) Filed: Jan. 27, 2003

(51) Int. Cl.[7] ..... A63B 69/00
(52) U.S. Cl. ..... 473/460
(58) Field of Search ..... 473/460, 459, 473/431, 434, 436

(56) References Cited

U.S. PATENT DOCUMENTS 3,815,907 A * 6/1974 Cook ..... 473/436
4,112,911 A * 9/1978 Petrick, Sr. ..... 124/56
6,186,132 B1 * 2/2001 Ko ..... 124/6
6,220,452 B1 * 4/2001 Yamashita et al. ..... 209/675

* cited by examiner

*Primary Examiner*—Raleigh W. Chiu
(74) *Attorney, Agent, or Firm*—Thomas, Kayden, Horstemeyer & Risley, LLP

(57) ABSTRACT

A jam free device for a table tennis serving machine includes a body provided with a through hole adapted to be defined to correspond to and coincide with the entrance of the table tennis serving machine, and a stirring extension movably extending into the through hole. Therefore, ping pong balls falling into the entrance of the table tennis serving machine are stirred by the stirring extension and will not jam the entrance.

5 Claims, 4 Drawing Sheets

JAM FREE DEVICE FOR A TABLE TENNIS SERVING MACHINE

BACKGROUND OF THE INVENTION

1. Field of the Invention

The present invention relates to a jam free device, and more particularly to a jam free device for a table tennis serving machine so that ping pong balls will not be jammed at the entrance of the table tennis serving machine.

2. Description of Related Art

A table tennis serving machine aims to serve ping pong balls for players so that the players are able to have exercises of dealing with different kinds of incoming balls. In order to have efficiency of fast serve, the table tennis serving machine is equipped with a pair of ball collecting trays to collect ping pong balls struck back by the players. At a joint of the two ball collecting trays, an entrance for the ping pong balls is defined such that the ping pong balls collected and received in the pair of ball collecting trays are able to fall in the table tennis serving machine. Thereafter, the ping pong balls in the table tennis serving machine are processed by devices in the machine to be served according to a predetermined program.

While using the table tennis serving machine to practice, players often want to practice the same kind of serve over and over until the perfect returning strategy is accomplished. However, players, from time to time, experience a major problem with the table tennis serving machine. That is, the ping pong balls are often jammed in the entrance of the table tennis serving machine, which interrupts the practice of the players. Although, the problem of the jammed ping pong balls can be solved by shaking the machine to loosen the jammed ping pong balls at the entrance. This problem already interrupts the practice of the players and thus consequently causes a concentration problem of the players.

To overcome the shortcomings, the present invention tends to provide an improved jam free device to mitigate and obviate the aforementioned problems.

SUMMARY OF THE INVENTION

The primary objective of the present invention is to provide an improved jam free device for a table tennis serving machine to avoid the ping pong balls from being jammed at the entrance of the table tennis serving machine.

In order to accomplish the foregoing objective, the jam free device of the present invention has a stirring extension movably extending into the entrance of the table tennis serving machine such that any jammed ping pong balls at the entrance of the table tennis serving machine become freed due to the stirring extension and are able to sequentially fall into the entrance of the table tennis serving machine.

Other objects, advantages and novel features of the invention will become more apparent from the following detailed description when taken in conjunction with the accompanying drawings.

DETAILED DESCRIPTION OF THE PREFERRED EMBODIMENT

Figure 1:
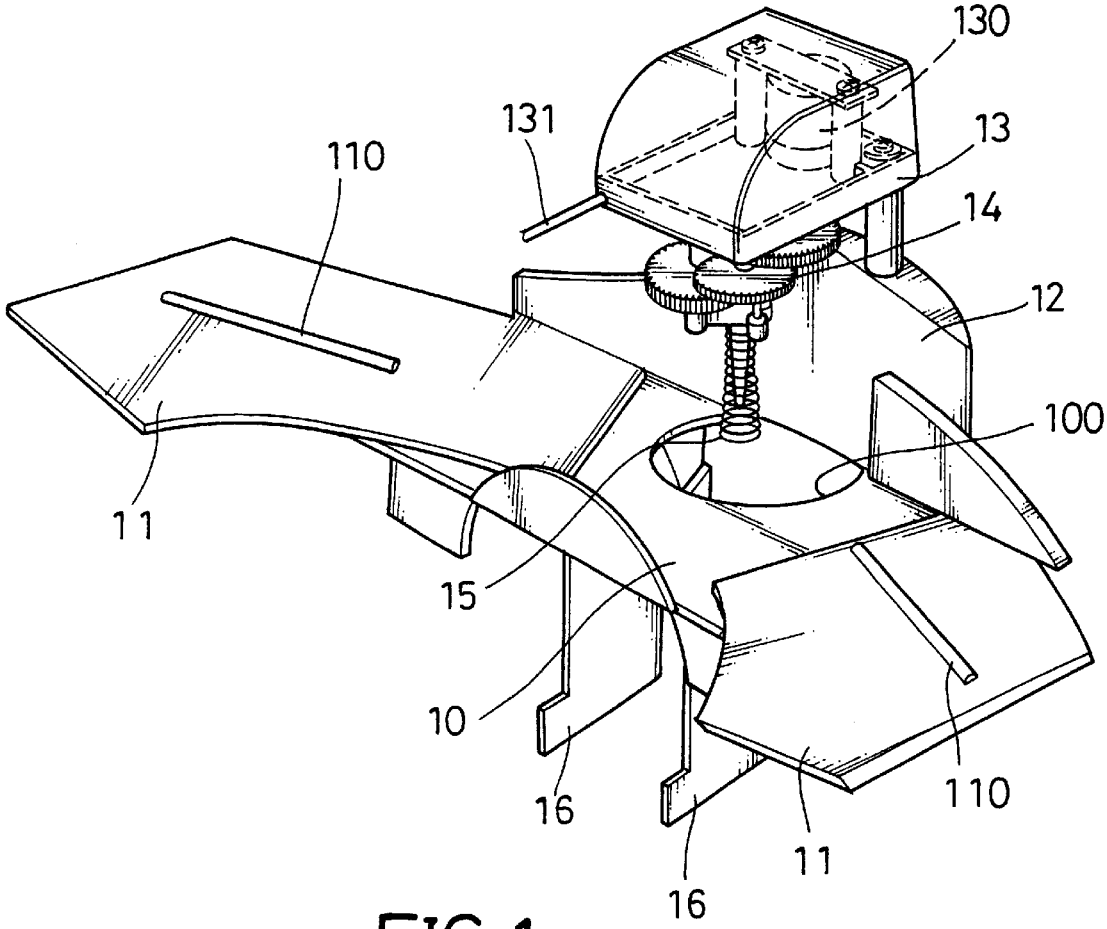
FIG. 1 is a perspective view of the jam free device of the present invention.

With reference to FIG. 1, the jam free device in accordance with the present invention includes a body (10) with two guiding plates (11) extending in opposite directions, a seat (12) formed on a top face of the body (10), a motor seat (13) mounted on top of the seat (12), a gear set (14) connected to a motor (130) inside the motor seat (13) and a stirring extension connected to and driven by the gear set (14).

Each of the guiding plates (11) has a rib (110) formed on a top face of the guiding plate (11) and at a joint between the two guiding plates (11), a through hole (100) is defined through the body (10). Two directing plates (16) facing each other are mounted on two opposite points on an outer periphery defining the through hole (100). The motor seat (13) has a wire (131) extending out therefrom so that the motor (130) inside the motor seat (13) is able to electrically connect to the table tennis serving machine (not shown).

Figure 2:
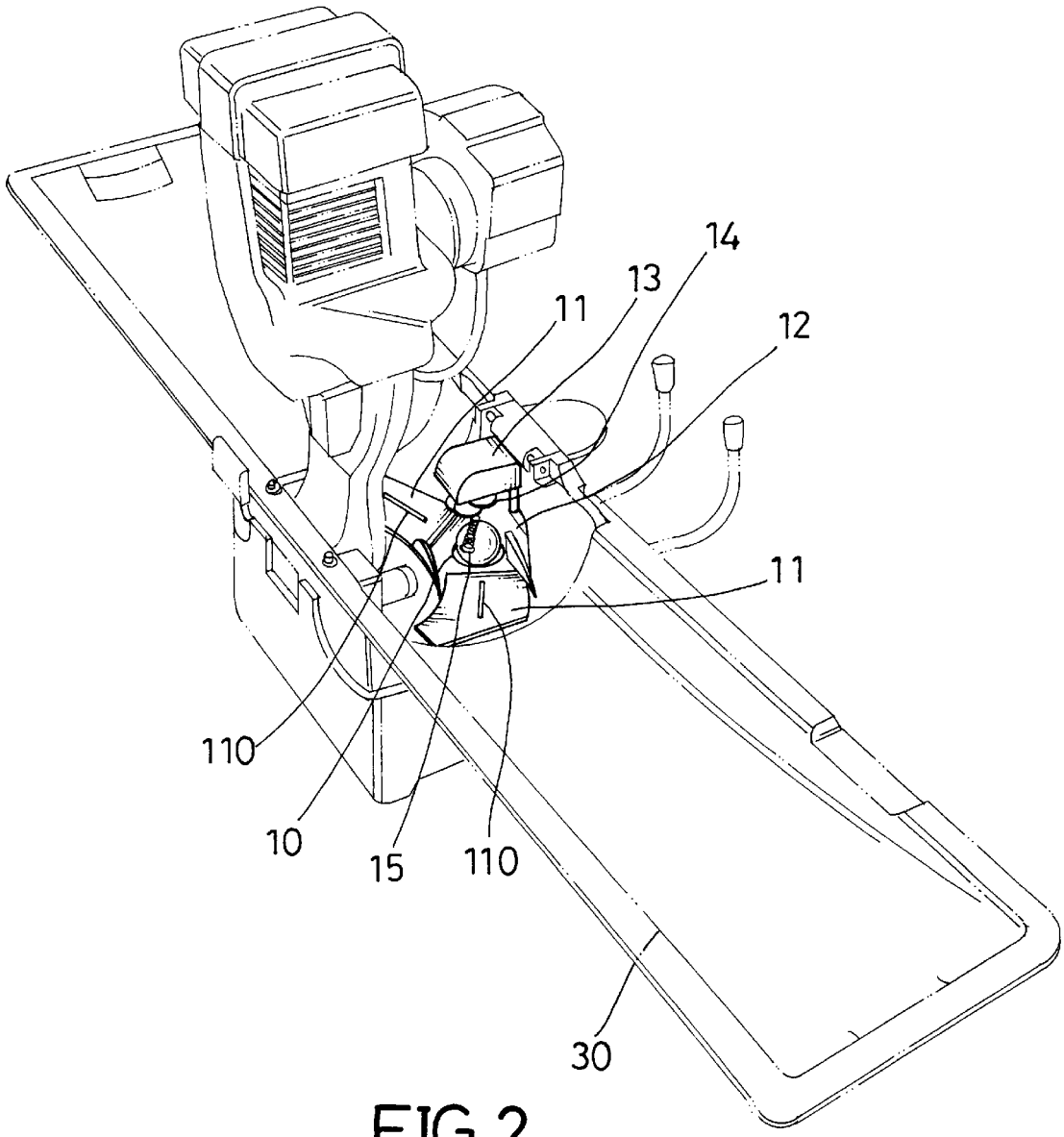
FIG. 2 is a schematic view showing the relationship between the table tennis serving machine and the jam free device of the present invention.

With reference to FIG. 2, when the jam free device of the present invention is used with the table tennis serving machine, the two guiding plates (11) are respectively placed on top of two oppositely formed ball collecting trays (30) of the table tennis serving machine, wherein the through hole (100) coincides and communicates with an entrance (not numbered) of the table tennis serving machine.

Figure 3:
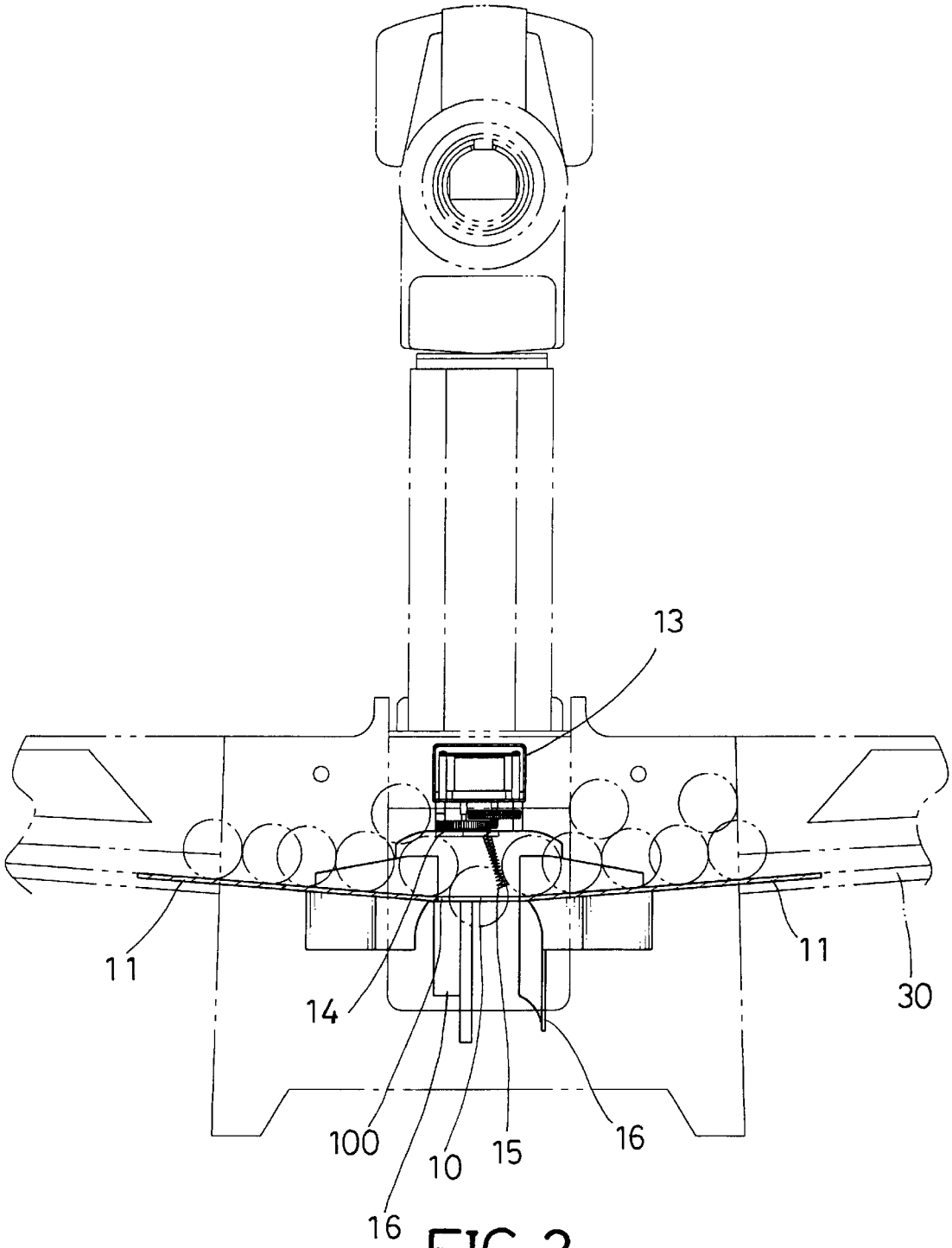
FIG. 3 is a schematic view showing the function of the stirring extension of the jam free device.
Figure 4:
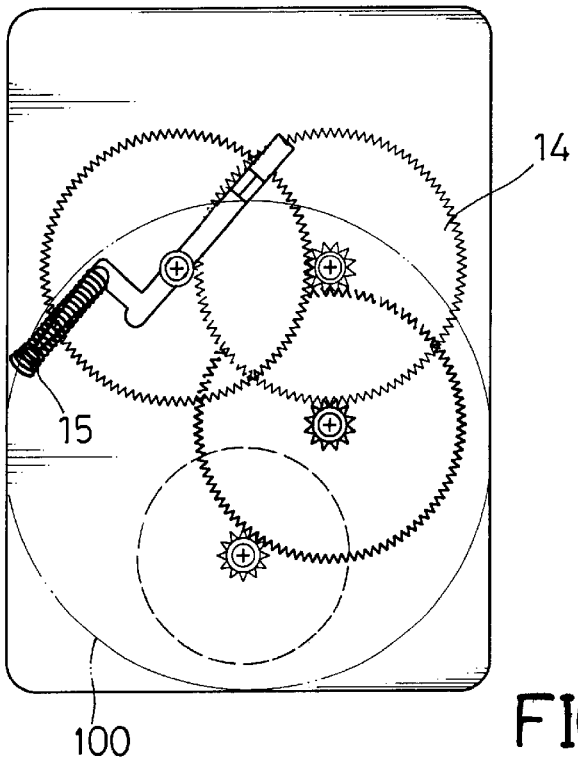
FIGS. 4 and 5 are schematic views showing the driven of the stirring extension of the jam free device by a gear set in the jam free device of the present invention.
Figure 5:
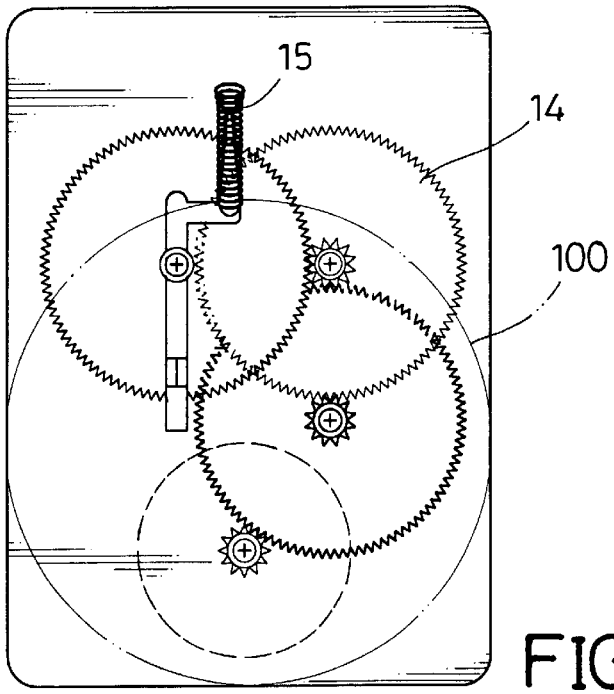

With reference to FIGS. 3, 4 and 5, because the through hole (100) communicates with the entrance of the table tennis serving machine, the two directing plates (16) extend into the entrance to direct the ping pong balls (shown in dashed lines). Because the stirring extension (15) is securely connected to the gear set (14), after the gear set (14) is driven by the motor (130) to rotate, the stirring extension (15) also rotates, which allows the stirring extension (15) to rotate along an inner contour defining the through hole (100) as well as the entrance. In order to avoid interference with the falling of the ping pong balls into the through hole (100), the through hole (100) has a diameter larger than a diameter of the ping pong ball. Thus, even when the stirring extension (15) is rotating in the through hole (100), the falling of the ping pong ball will not be interfered with.

To sum up of the present invention, with the stirring extension (15), ping pong balls in a table tennis serving machine will not jam in the entrance of the table tennis serving machine.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A jam free device for a table tennis serving machine having a pair of oppositely formed ball collecting trays and an entrance defined at a joint between the pair of ball collecting trays, the jam free device comprising:

a body provided with a through hole adapted to be defined to correspond to and coincide with the entrance of the table tennis serving machine; and a stirring extension movably extending into the through hole such that ping pong balls falling into the entrance are stirred by the stirring extension and will not jam the entrance.

2. The jam free device as claimed in claim 1 further comprising a pair of opposite guiding plates extending out from the body and adapted to be placed on top of the ball collecting trays.

3. The jam free device as claimed in claim 2, wherein each of the guiding plates has a rib formed on a top face of the guiding plate so that ping pong balls are able to be initially separated.

4. The jam free device as claimed in claim 2 further comprising a motor mounted on top of the body and a gear set securely connected to and driven by the motor.

5. The jam free device as claimed in claim 4, wherein the stirring extension is connected to the gear set so that the stirring extension is driven by the motor to rotate along an inner contour defining the through hole.

* * * * *